US010656555B2

(12) United States Patent
Imai et al.

(10) Patent No.: US 10,656,555 B2
(45) Date of Patent: May 19, 2020

(54) DEVELOPMENT ROLL FOR ELECTROPHOTOGRAPHY DEVICE

(71) Applicant: Sumitomo Riko Company Limited, Aichi (JP)

(72) Inventors: Kentaro Imai, Aichi (JP); Kadai Takeyama, Aichi (JP); Yutaka Kadoshima, Aichi (JP); Kosuke Minematsu, Aichi (JP); Satoshi Tatsumi, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 0 days.

(21) Appl. No.: 16/568,293

(22) Filed: Sep. 12, 2019

(65) Prior Publication Data

US 2020/0012210 A1 Jan. 9, 2020

Related U.S. Application Data

(63) Continuation of application No. PCT/JP2018/006366, filed on Feb. 22, 2018.

(30) Foreign Application Priority Data

Apr. 27, 2017 (JP) ..... 2017-087913

(51) Int. Cl.
*G03G 15/08* (2006.01)

(52) U.S. Cl.
CPC . *G03G 15/0818* (2013.01); *G03G 2215/0861* (2013.01)

(58) Field of Classification Search
CPC ..... G03G 15/0818; G03G 2215/0861
See application file for complete search history.

(56) References Cited

U.S. PATENT DOCUMENTS 6,090,492 A * 7/2000 Tsuchiya ..... G03G 15/0818 428/35.9
2004/0190949 A1* 9/2004 Yamaguchi ..... G03G 15/0818 399/286

(Continued)

FOREIGN PATENT DOCUMENTS

JP 2002031946 1/2002
JP 3997644 10/2007

(Continued)

OTHER PUBLICATIONS

"International Search Report (Form PCT/ISA/210)" of PCT/JP2018/006366, dated Mar. 27, 2018, with English translation thereof, pp. 1-4.

*Primary Examiner* — Sophia S Chen
(74) *Attorney, Agent, or Firm* — JCIPRNET

(57) ABSTRACT

Provided is a development roll for electrophotography devices in which image defects are suppressed and which achieve both maintenance of high charging properties and discharging properties. The development roll is provided with a shaft member, an elastic substance layer formed on the outer circumference of the shaft member, an intermediate layer formed on the outer circumference of the elastic substance layer, and a surface layer formed on the outer circumference of the intermediate layer. The volume resistivity of the surface layer 18 is within the range of $1.0\times10^{14}$ to $1.0\times10^{20}$ Ω·cm, and the volume resistivity of the intermediate layer 16 is within the range of $1.0\times10^{7}$ to $1.0\times10^{13}$ Ω·cm.

16 Claims, 1 Drawing Sheet

10

(56) References Cited

U.S. PATENT DOCUMENTS

| | | | | |
|---|---|---|---|---|
| 2011/0229202 | A1 | 9/2011 | Mizumoto et al. | |
| 2013/0302070 | A1* | 11/2013 | Oosaku ..... | G03G 15/0818 399/286 |
| 2017/0010562 | A1* | 1/2017 | Wakabayashi ..... | G03G 15/0818 |

FOREIGN PATENT DOCUMENTS

| | | |
|---|---|---|
| JP | 2008158216 | 7/2008 |
| JP | 2009069299 | 4/2009 |
| JP | 4373462 | 11/2009 |
| JP | 4761546 | 8/2011 |

* cited by examiner

10

DEVELOPMENT ROLL FOR ELECTROPHOTOGRAPHY DEVICE

CROSS-REFERENCE TO RELATED APPLICATION

The present application is a continuation of PCT/JP2018/006366, filed on Feb. 22, 2018, and is related to and claims priority from Japanese patent application no. 2017-087913, filed on Apr. 27, 2017. The entire contents of the aforementioned application are hereby incorporated by reference herein.

BACKGROUND

Technical Field

The disclosure relates to a development roll for electrophotography devices, which is suitable to be used in an electrophotography device such as a copying machine, a printer or a facsimile machine that adopts an electrophotographic system.

Related Art

In the electrophotography device, the development roll has a role of sufficiently charging toner and carrying toner in an amount required for printing to the photoreceptor. For example, Patent Document 1 (Japanese Patent No. 4761546) has disclosed a development roll for electrophotography devices, which includes at least one elastic layer on a shaft core and at least one surface layer on the outer circumference of the elastic layer, wherein the surface layer is composed of a thermoplastic resin, and the thermoplastic resin is selected from a group consisting of fluorine resin, thermoplastic polyimide, polyamide, polyethylene, polypropylene and polystyrene. In addition, for example, Patent Document 2 (Japanese Patent No. 3997644) has disclosed a development roll, which includes a base rubber layer formed on the outer circumferential surface of a shaft member, an intermediate layer formed on the outer circumference of the base rubber layer, and a surface layer formed on the outer circumference of the intermediate layer, wherein the surface electrical resistance of each layer is within a predetermined range. Further, for example, Patent Document 3 (Japanese Patent No. 4373462) has disclosed a development roll that has a surface layer, composed of metal, a metal oxide or the like, on the surface of a base material molded from cross-linked rubber, a thermoplastic resin or a thermoplastic elastomer.

In order for the development roll to stably exhibit its functions, it is required to improve the charging properties of the development roll. Therefore, it may use a material that easily charges the toner (in consideration of triboelectric series) as the surface layer. However, if the material that easily charges the toner is used alone as the surface layer, the charge accumulated in the surface layer may be easily released due to the relationship with the adjacent layer, etc. and, for example, the function of continuously outputting high quality images may be degraded. Also, the surface layer composed of polystyrene, a metal oxide or the like may have high resistance and hardly conduct electricity. As a result, the charge may not be released from the surface layer even after toner conveyance, and the residual charge may deteriorate the image.

In view of the above, the disclosure provides a development roll for an electrophotography device, which achieves maintenance of high charging properties as well as discharging properties to suppress image defects.

SUMMARY

In view of the above, a development roll for an electrophotography device according to the disclosure includes a shaft member; an elastic substance layer formed on an outer circumference of the shaft member; an intermediate layer formed on an outer circumference of the elastic substance layer; and a surface layer formed on an outer circumference of the intermediate layer. The surface layer comprises a resin and the resin is one or two or more selected from a styrene resin, polyether sulfone, and polyamide imide. A volume resistivity of the surface layer is in a range of $1.0\times10^{15}$ to $1.0\times10^{20}$ Ω·cm, and a volume resistivity of the intermediate layer is in a range of $1.0\times10^{9}$ to $1.0\times10^{13}$ Ω·cm.

BRIEF DESCRIPTION OF THE DRAWINGS

FIG. 1(*b*) is a cross-sectional view taken along the line A-A.

DESCRIPTION OF THE EMBODIMENTS

Figure 1A:
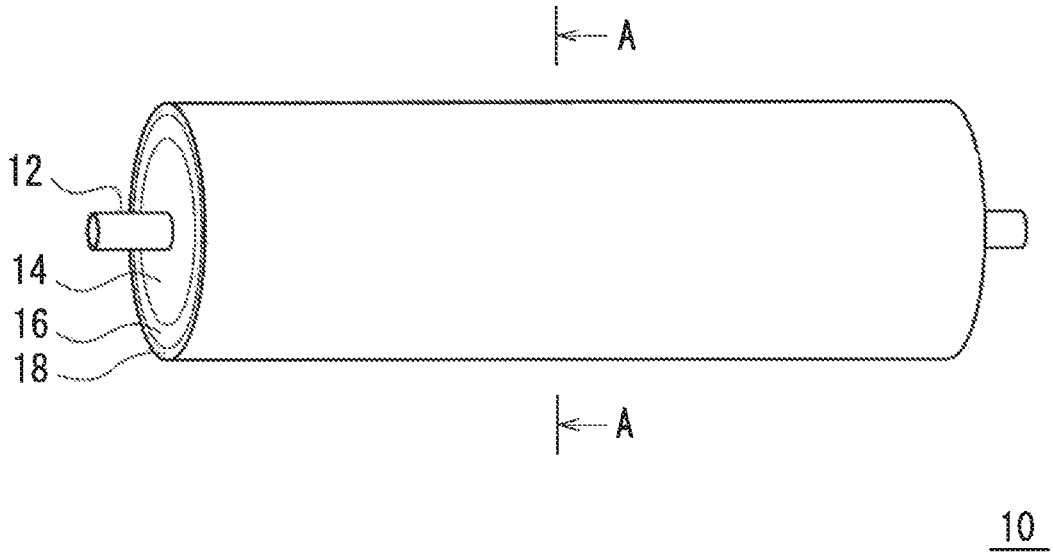
FIG. 1(*a*) is a schematic view showing the appearance of a development roll for an electrophotography device according to an embodiment of the disclosure.
Figure 1B:
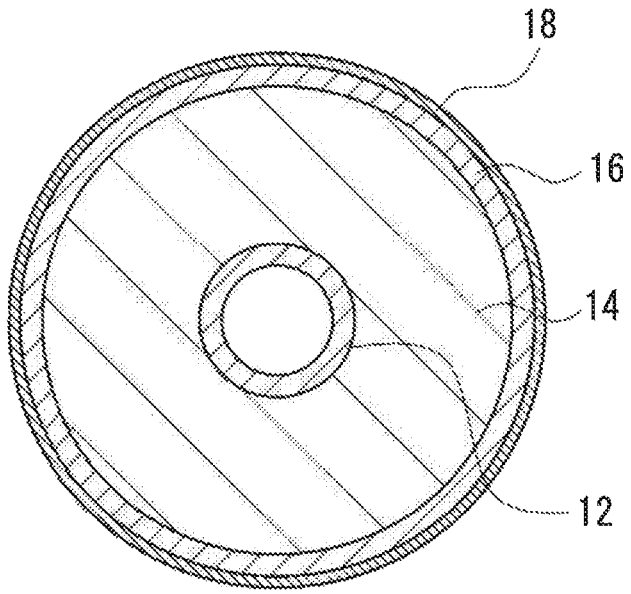

A development roll for an electrophotography device (may be referred to simply as development roll hereinafter) according to the disclosure will be described in detail. FIG. 1(*a*) is a schematic view showing the appearance of the development roll for the electrophotography device according to an embodiment of the disclosure, and FIG. 1(*b*) is a cross-sectional view taken along the line A-A.

The development roll 10 includes a shaft member 12, an elastic substance layer 14 formed on the outer circumference of the shaft member 12, an intermediate layer 16 formed on the outer circumference of the elastic substance layer 14, and a surface layer 18 formed on the outer circumference of the intermediate layer 16. The elastic substance layer 14 is a layer (base layer) that serves as the base of the development roll 10. The surface layer 18 is a layer that appears on the surface of the development roll 10.

In the development roll 10, the volume resistivity of the surface layer 18 is set in the range of $1.0\times10^{14}$ to $1.0\times10^{20}$ Ω·cm. Besides, the volume resistivity of the intermediate layer 16 is set in the range of $1.0\times10^{7}$ to $1.0\times10^{13}$ Ω·cm. As the surface layer 18 has a high resistance, a volume resistivity of $1.0\times10^{14}$ Ω·cm or more, it is possible to achieve high charging properties. Then, with respect to the surface layer 18 that has a volume resistivity of $1.0\times10^{14}$ Ω·cm or more, the intermediate layer 16 has a volume resistivity of $1.0\times10^{7}$ Ω·cm or more. Thereby, it is possible to suppress the charge from releasing and maintain high charging properties. In addition, with respect to the surface layer 18 that has a volume resistivity of $1.0\times10^{14}$ Ω·cm or more, the intermediate layer 16 has a volume resistivity of $1.0\times10^{13}$ Ω·cm or less. Thereby, it is possible to achieve appropriate discharging properties and suppress image defects caused by residual charge. That is, by providing the intermediate layer 16 that has a volume resistivity of $1.0\times10^{7}$ to $1.0\times10^{13}$ Ω·cm with respect to the surface layer 18 that has a volume resistivity of $1.0\times10^{14}$ Ω·cm or more, it is possible to achieve maintenance of high charging properties as well as discharging properties to suppress image defects.

From the perspective of improving the charging properties, etc., the volume resistivity of the surface layer 18 may be $1.0\times10^{15}$ Ω·cm or more. Further, from the perspective of improving the discharging properties, etc., the volume resistivity may be $1.0\times10^{19}$ Ω·cm or less.

From the perspective of achieving better effects in suppressing charge releasing, the volume resistivity of the intermediate layer 16 may be $1.0\times10^{9}$ Ω·cm or more. Further, from the perspective of improving the discharging properties and achieving better effects in suppressing image defects caused by residual charge, the volume resistivity may be $1.0\times10^{12}$ Ω·cm or less, and may be $1.0\times10^{11}$ Ω·cm or less.

The volume resistivity can be measured in accordance with JIS K6911. The volume resistivity of the surface layer 18 and the volume resistivity of the intermediate layer 16 may be adjusted through selection of the materials, adjustment of the molecular weights of the materials, compounding of a conductive agent, etc. For example, if the molecular weight increases, it tends to be hard and have high resistance. In addition, if the copolymer component is small, it tends to be hard and have high resistance. Since the breaking strength tends to decrease as the hardness and resistance increase, the molecular weight of the material may be adjusted also in consideration of the breaking strength.

The surface layer 18 may include one, two or more of a resin, a metal oxide, and a silicon compound as the material. One of these may be used alone as the material of the surface layer 18, or two or more may be used in combination. Among these, it may include a resin. If the surface layer 18 includes a resin, brittle fracture is suppressed due to improvement in stretch and the durability is improved. The resin may be a thermoplastic resin or a thermosetting resin. Among the thermoplastic resin and thermosetting resin, the thermoplastic resin may be used from the perspective of workability, etc.

The resin may be a (meth)acrylic resin, a styrene resin, polyether sulfone, a fluorine resin, polyamide-imide and the like. If the surface layer 18 includes these resins, it is easy to form a hard and highly resistive surface layer. One of these may be used alone as the material of the surface layer 18, or two or more may be used in combination. Among these, the (meth)acrylic resin and styrene resin may be used from the perspective of moldability, etc.

The (meth)acrylic resin is a resin selected from an acrylic resin and a methacrylic resin. The (meth)acrylic resin may be a polymer of (meth)acrylate (homopolymer or copolymer), a polymer of a modified product obtained by adding a fluorine-containing group, a silicone group (polydimethylsiloxane, etc.) and the like to a (meth)acrylic resin and the like. The (meth)acrylate may be monofunctional or polyfunctional.

The monofunctional (meth)acrylate may be (meth)acrylate having a hydroxyl group such as 2-hydroxyethyl (meth) acrylate, 2-hydroxypropyl (meth)acrylate and 3-chloro-2-hydroxypropyl (meth)acrylate, alkyl (meth)acrylate such as methyl (meth)acrylate, ethyl (meth)acrylate, propyl (meth) acrylate, butyl (meth)acrylate, isoamyl (meth)acrylate, 2-ethylhexyl (meth)acrylate, lauryl (meth)acrylate and stearyl (meth)acrylate, cycloalkyl (meth)acrylate such as cyclohexyl (meth)acrylate, halogenated alkyl (meth)acrylate such as chloroethyl (meth)acrylate and chloropropyl (meth) acrylate, alkoxyalkyl (meth)acrylate such as methoxyethyl (meth)acrylate, ethoxyethyl (meth)acrylate and butoxyethyl (meth)acrylate, phenoxyalkyl (meth)acrylate such as phenoxyethyl acrylate and nonyl phenoxyethyl (meth)acrylate, alkoxy alkylene glycol (meth)acrylate such as ethoxydiethylene glycol (meth)acrylate, methoxytriethylene glycol (meth)acrylate and methoxydipropylene glycol (meth)acrylate, 2,2-Dimethylaminoethyl (meth)acrylate, 2,2-diethylaminoethyl (meth)acrylate, 2-hydroxyethyl (meth)acrylate, 3-chloro-2-hydroxypropyl (meth)acrylate, fluoroalkyl group modified acrylate, polydimethylsiloxane modified acrylate and the like.

The polyfunctional (meth)acrylate may be alkyldiol di(meth)acrylate such as 1,9-nonanediol di(meth)acrylate, polyethylene glycol di(meth)acrylate such as diethylene glycol di(meth)acrylate, polypropylene glycol di(meth)acrylate such as dipropylene glycol di(meth)acrylate, trimethylolpropane tri(meth)acrylate, pentaerythritol tri(meth)acrylate, pentaerythritol tetra(meth)acrylate, glycerol tri(meth) acrylate, polyvalent (meth)acrylate obtained by addition reaction of ethylene glycol diglycidyl ether with a compound having an ethylenically unsaturated bond such as unsaturated carboxylic acid and unsaturated alcohol and an active hydrogen, polyvalent (meth)acrylate obtained by addition reaction of an unsaturated epoxy compound such as glycidyl (meth)acrylate and a compound having an active hydrogen such as carboxylic acid or an amine, a multivalent (meth)acrylamide such as methylene bis (meth)acrylamide, a polyvalent vinyl compound such as divinylbenzene and the like.

The styrene resin is selected from a polymer of styrene (polystyrene) and a copolymer of styrene (polymer having styrene as a main component). The styrene resin may be general purpose polystyrene (GPPS), high impact polystyrene (HIPS), acrylonitrile-styrene (AS) resin, acrylonitrile-butadiene-styrene (ABS) resin and the like. The general purpose polystyrene (GPPS) is composed of a homopolymer of styrene and is hard but brittle and has poor impact resistance. The high impact polystyrene (HIPS) is obtained by compounding rubber with GPPS in order to improve impact resistance.

The fluorine resin is a resin including fluorine. The fluorine resin may be fully fluorinated resin such as polytetrafluoroethylene (PTFE), polychlorotrifluoroethylene (CTFE), polyvinylidene fluoride, partially fluorinated resin such as polyvinyl fluoride, perfluoroalkoxy fluorine resin (PFA), tetrafluoroethylene-hexafluoropropylene copolymer (FEP), ethylene-tetrafluoroethylene copolymer (ETFE), fluorinated resin copolymer such as ethylene-chlorotrifluoroethylene copolymer (ECTFE) and the like. One of these may be used alone as the fluorine resin, or two or more may be used in combination. Among these, partially fluorinated resin such as polyvinylidene fluoride and polyvinyl fluoride may be used from the perspective of film formability (coatability), etc.

The metal oxide may be aluminum oxide, magnesium oxide, titanium oxide, zirconium oxide and the like. One of these may be used alone as the material of the surface layer 18, or two or more may be used in combination. Among these, aluminum oxide may be used from the perspective of high resistance, etc.

The silicon compound may be silicon oxide, a reactant of alkoxysilane, a reactant of a silane coupling agent, a reactant of silazane, a reactant of polysilazane and the like.

The tensile elastic modulus of the surface layer 18 may be in the range of 500 MPa to 7000 MPa. If the tensile elastic modulus of the surface layer 18 is 500 MPa or more, it is possible to form a hard and highly resistive surface layer and it is easy to maintain high charging properties. From this perspective, the tensile elastic modulus of the surface layer 18 may be 1000 MPa or more, and even may be 2000 MPa or more. On the other hand, if the tensile elastic modulus of the surface layer 18 is 7000 MPa or less, it has excellent followability to the elastic substance layer 14 and the intermediate layer 16. From this perspective, the tensile elastic modulus of the surface layer 18 may be 6000 MPa or less, and even may be 5000 MPa or less. The tensile elastic modulus of the surface layer 18 can be measured in accordance with JIS K7161, 7127 by punching a sheet sample obtained from the material for forming the surface layer 18 into any shape.

The tensile fracture strain of the surface layer 18 may be 5.0% or more. If the tensile fracture strain of the surface layer 18 is 5.0% or more, brittle fracture is suppressed due to improvement in stretch and the durability is improved. The tensile fracture strain of the surface layer 18 can be measured in accordance with JIS K7161, 7127 by punching a sheet sample obtained from the material for forming the surface layer 18 into any shape.

The thickness of the surface layer 18 may be in the range of 0.1 to 3.0 μm. If the thickness of the surface layer 18 is 0.1 μm or more, it is easy to ensure high charging properties (initial charging properties) in the highly resistive surface layer that has a volume resistivity of $1.0\times10^{14}$ Ω·cm or more. From this perspective, the thickness of the surface layer 18 may be 0.5 μm or more, and even may be 1.0 μm or more. On the other hand, if the thickness of the surface layer 18 is 3.0 μm or less, it is easy to ensure appropriate discharging properties. From this perspective, the thickness of the surface layer 18 may be 2.5 μm or less. Then, if the thickness of the surface layer 18 is in the range of 0.1 to 3.0 μm, it is easy to achieve maintenance of high charging properties as well as discharging properties. The thickness of the surface layer 18 can be measured by observing the cross section using a laser microscope (for example, "VK-9510" or the like manufactured by KEYENCE). For example, the distance from the surface of the intermediate layer 16 to the surface of the surface layer 18 may be measured at any five positions, and the thickness may be represented by the average.

The surface layer 18 may include an additive, in addition to one, two or more of the resin, metal oxide, and silicon compound described above, if the disclosure is not affected. The additive may be a conductive agent, a filler, a stabilizer, a UV absorber, a lubricant, a release agent, a dye, a pigment, a flame retardant and the like.

The surface layer 18 may be formed by applying the material for forming the surface layer 18 to the outer circumferential surface of the intermediate layer 16 and performing a heat treatment, a crosslinking treatment or the like as required. The material for forming the surface layer 18 may include an additive or a dilution solvent, in addition to one, two or more of the resin, metal oxide, and silicon compound described above. The dilution solvent may be ketone solvent such as methyl ethyl ketone (MEK) and methyl isobutyl ketone, alcohol solvent such as isopropyl alcohol (IPA), methanol and ethanol, hydrocarbon solvent such as hexane and toluene, acetic acid solvent such as ethyl acetate and butyl acetate, ether solvent such as diethyl ether and tetrahydrofuran, water and the like.

The tensile elastic modulus of the intermediate layer 16 may be in the range of 5.0 to 500 MPa. If the tensile elastic modulus of the intermediate layer 16 is 5.0 MPa or more, it has appropriate hardness and is excellent in durability (abrasion resistance), etc. From this perspective, the tensile elastic modulus of the intermediate layer 16 may be 7.5 MPa or more, and even may be 10 MPa or more. On the other hand, if the tensile elastic modulus of the intermediate layer 16 is 500 MPa or less, it is softer than the surface layer 18, and the brittle fracture of the surface layer 18 is suppressed so that the durability is easily improved. From this perspective, the tensile elastic modulus of the intermediate layer 16 may be 400 MPa or less, and even may be 300 MPa or less. Then, if the tensile elastic modulus of the intermediate layer 16 is in the range of 5.0 to 500 MPa, it has excellent abrasion resistance and durability. In addition, it is easy to set the volume resistivity of the intermediate layer 16 to the desired range. The tensile elastic modulus of the intermediate layer 16 can be measured in accordance with JIS K7161, 7127 by punching a sheet sample obtained from the material for forming the intermediate layer 16 into any shape. The intermediate layer 16 has a smaller tensile elastic modulus than the surface layer 18 and is more flexible than the surface layer 18. Thus, it is easy to set the volume resistivity of the intermediate layer 16 less than the volume resistivity of the surface layer 18.

The thickness of the intermediate layer 16 is not particularly limited and may be set in the range of 1.0 to 30 μm, for example. The thickness of the intermediate layer 16 can be measured by observing the cross section using a laser microscope (for example, "VK-9510" or the like manufactured by KEYENCE). For example, the distance from the surface of the elastic substance layer 14 to the surface of the intermediate layer 16 may be measured at any five positions, and the thickness may be represented by the average.

The material of the intermediate layer 16 may be polyurethane, (meth)acrylic resin and the like. One of these may be used alone as the material of the intermediate layer 16, or two or more may be used in combination. Among these, polyurethane may be used from the perspective of resistance control and flexibility, etc.

The intermediate layer 16 may or may not include an additive, in addition to polyurethane and (meth)acrylic resin, if the disclosure is not affected. Such an additive may be a conductive agent, a filler, a stabilizer, a UV absorber, a lubricant, a release agent, a dye, a pigment, a flame retardant and the like.

The conductive agent may be an ion conductive agent and an electron conductive agent. The ion conductive agent may be quaternary ammonium salt, quaternary phosphonium salt, borate, surfactant and the like. The electron conductive agent may be carbon black, graphite, conductive oxide such as c-$TiO_2$, c-ZnO, c-$SnO_2$, etc. (c- means conductivity) and the like.

The intermediate layer 16 may be formed by applying the material for forming the intermediate layer 16 to the outer circumferential surface of the elastic substance layer 14 and performing a drying treatment or the like as appropriate. The material for forming the intermediate layer 16 may include a dilution solvent. The dilution solvent may be ketone solvent such as methyl ethyl ketone (MEK) and methyl isobutyl ketone, alcohol solvent such as isopropyl alcohol (IPA), methanol and ethanol, hydrocarbon solvent such as hexane and toluene, acetic acid solvent such as ethyl acetate and butyl acetate, ether solvent such as diethyl ether and tetrahydrofuran, water and the like.

The elastic substance layer 14 includes crosslinked rubber. The elastic substance layer 14 is formed of a conductive rubber composition that includes uncrosslinked rubber. The crosslinked rubber is obtained by crosslinking the uncrosslinked rubber. The uncrosslinked rubber may be polar rubber or non-polar rubber.

The polar rubber is rubber having a polar group, and the polar group may be a chloro group, a nitrile group, a carboxyl group, an epoxy group and the like. Specifically, the polar rubber may be hydrin rubber, nitrile rubber (NBR), urethane rubber (U), acrylic rubber (copolymer of acrylic ester and 2-chloroethyl vinyl ether, ACM), chloroprene rubber (CR), epoxidized natural rubber (ENR) and the like. Among the polar rubber, hydrin rubber and nitrile rubber (NBR) may be used the perspective that the volume resistivity particularly tends to be low.

The hydrin rubber may be a homopolymer of epichlorohydrin (CO), epichlorohydrin-ethylene oxide binary copolymer (ECO), epichlorohydrin-allyl glycidyl ether binary copolymer (GCO), epichlorohydrin-ethylene oxide-allyl glycidyl ether terpolymer (GECO) and the like.

The urethane rubber may be polyether type urethane rubber which has an ether bond in the molecule. The polyether type urethane rubber may be produced by reaction of polyether having a hydroxyl group at both ends with diisocyanate. The polyether is not particularly limited and may be polyethylene glycol, polypropylene glycol and the like. The diisocyanate is not particularly limited and may be olylene diisocyanate, diphenylmethane diisocyanate and the like.

The non-polar rubber may be silicone rubber (Q), isoprene rubber (IR), natural rubber (NR), styrene butadiene rubber (SBR), butadiene rubber (BR) and the like. Among the non-polar rubber, silicone rubber may be used from the perspective that it has low hardness and is hardly fatigued (excellent elastic recovery).

The crosslinking agent may be a sulfur crosslinking agent, a peroxide crosslinking agent, a dechlorination crosslinking agent and the like. These crosslinking agents may be used alone, or two or more may be used in combination.

The sulfur crosslinking agent may be a conventionally known sulfur crosslinking agent such as powdered sulfur, precipitated sulfur, colloidal sulfur, surface-treated sulfur, insoluble sulfur, sulfur chloride, thiuram-based vulcanization accelerator, polymer polysulfide and the like.

The peroxide crosslinking agent may be a conventionally known peroxide crosslinking agent such as peroxy ketal, dialkyl peroxide, peroxy ester, ketone peroxide, peroxy dicarbonate, diacyl peroxide, hydro peroxide and the like.

The dechlorination crosslinking agent may be a dithiocarbonate compound. More specifically, the dechlorination crosslinking agent may be quinoxaline-2,3-dithiocarbonate, 6-methylquinoxaline-2,3-dithiocarbonate, 6-isopropylquinoxaline-2,3-dithiocarbonate, 5,8-dimethylquinoxaline-2,3-dithiocarbonate and the like.

The amount of the crosslinking agent to be compounded may be in the range of 0.1 to 2 parts by mass, may be in the range of 0.3 to 1.8 parts by mass, and even may be in the range of 0.5 to 1.5 parts by mass with respect to 100 parts by mass of uncrosslinked rubber from the perspective that it is hard to bleed.

When the dechlorination crosslinking agent is used as the crosslinking agent, a dechlorination crosslinking accelerator may be used in combination. The dechlorination crosslinking accelerator may be 1,8-diazabicyclo (5,4,0) undecen-7 (hereinafter, abbreviated as DBU) or a weak acid salt thereof. Although the dechlorination crosslinking accelerator may be used in the form of DBU, it may be used in the form of the weak acid salt from the perspective of operatability. The weak acid salt of DBU may be carbonate, stearate, 2-ethylhexylate, benzoate, salicylate, 3-hydroxy-2-naphthoate, phenol resin salt, 2-mercaptobenzothiazole salt, 2-mercaptobenzimidazole salt and the like.

The content of the dechlorination crosslinking accelerator may be in the range of 0.1 to 2 parts by mass with respect to 100 parts by mass of the uncrosslinked rubber from the perspective that it is hard to bleed. Further, it may be in the range of 0.3 to 1.8 parts by mass, and even may be in the range of 0.5 to 1.5 parts by mass.

To add conductivity, a conventionally known conductive agent such as carbon black, graphite, c-$TiO_2$, c-ZnO, c-$SnO_2$ (c- means conductivity), an ion conductive agent (quaternary ammonium salt, borate, surfactant, etc.) and the like may be added to the elastic substance layer 14 as appropriate. In addition, various additives may be added as appropriate if required. The additive may be a lubricant, a vulcanization accelerator, an anti-aging agent, a light stabilizer, a viscosity modifier, a processing aid, a flame retardant, a plasticizer, a foaming agent, a filler, a dispersant, an antifoam, a pigment, a release agent and the like.

The elastic substance layer 14 may be adjusted to a predetermined volume resistivity according to the type of the crosslinked rubber, the amount of the ion conductive agent compounded, compounding of the electron conductive agent, etc. The volume resistivity of the elastic substance layer 14 is appropriately set in the range of $10^2$ to $10^{10}$ Ω·cm, $10^3$ to $10^9$ Ω·cm, $10^4$ to $10^8$ Ω·cm or the like according to the application, etc.

The thickness of the elastic substance layer 14 is not particularly limited and may be appropriately set in the range of 0.1 to 10 mm according to the application, etc.

The elastic substance layer 14 may be formed as described below, for example. First, the shaft member 12 is disposed coaxially in the hollow portion of a roll forming mold, and the uncrosslinked conductive rubber composition is injected and heated and cured (crosslinked). Then, the mold is removed or the uncrosslinked conductive rubber composition is extruded on the surface of the shaft member 12 so as to form the elastic substance layer 14 on the outer circumference of the shaft member 12.

The shaft member 12 is not particularly limited if it has conductivity. Specifically, the shaft member 12 may be a solid body made of metal such as iron, stainless steel, aluminum, etc., a core metal having a hollow body and the like, for example. An adhesive, a primer and the like may be applied to the surface of the shaft member 12 if required. In other words, the elastic substance layer 14 may be bonded to the shaft member 12 via an adhesive layer (primer layer). The adhesive, the primer and the like may be conductive if required.

The development roll 10 having the above configuration includes the elastic substance layer 14, the intermediate layer 16, and the surface layer 18 in this order on the outer circumference of the shaft member 12, in which the volume resistivity of the surface layer 18 is in the range of $1.0\times10^{14}$ to $1.0\times10^{20}$ Ω·cm, and the volume resistivity of the intermediate layer 16 is in the range of $1.0\times10^{7}$ to $1.0\times10^{13}$ Ω·cm. Therefore, it is possible to achieve maintenance of high charging properties as well as discharging properties to suppress image defects.

EMBODIMENT

Hereinafter, the disclosure will be described in detail using embodiments and comparative examples.

Embodiments 1 to 5 and 7 to 17 and Comparative Examples 1 to 5

<Preparation of the Composition for the Elastic Substance Layer>

The composition for the elastic substance layer was prepared by mixing conductive silicone rubber ("X-34-264

A/B, mixing mass ratio A/B=1/1", produced by Shin-Etsu Chemical Co., Ltd.) with a static mixer.

<Preparation of the Elastic Substance Layer>

A solid columnar iron rod with a diameter of 6 mm was prepared as the shaft member, and an adhesive was applied to the outer circumferential surface of the shaft member. After the shaft member was set in the hollow space of a roll forming mold, the prepared composition for the elastic substance layer was injected into the hollow space and heated at 190° C. for 30 minutes to be cured, and demolded. Thereby, a roll-shaped elastic substance layer (3 mm thick) composed of conductive silicone rubber was formed along the outer circumferential surface of the shaft member.

<Preparation of the Intermediate Layer>

Each component was compounded so as to obtain the composition (parts by mass) shown in Tables 1 to 3, and the concentration was adjusted with a dilution solvent (MIBK) so as to obtain a solid content concentration of 25 mass %, thereby preparing the composition for the intermediate layer. Next, the composition for the intermediate layer was roll-coated on the outer circumferential surface of the elastic substance layer and a heat treatment was performed to form the intermediate layer (20 μm thick) on the outer circumference of the elastic substance layer.

The materials used as the intermediate layer material are as follows.

Thermoplastic polyurethane: "Nipporan 5196" produced by Nippon Polyurethane Industry Co., Ltd.

Acrylic resin (1): "Parachron W-197C" produced by Negami Chemical Industrial Co., Ltd.

Acrylic resin (2): "Parachron Precoat 200" produced by Negami Chemical Industrial Co., Ltd.

Carbon black: "Ketjen EC300J" produced by Lion Specialty Chemicals Co., Ltd.

Ether-based polyol: "Adeka Polyether P-1000" produced by ADEKA

Isocyanurate: "Coronate HL" produced by Tosoh

<Preparation of the Surface Layer>

The binder shown in Tables 1 to 3 was compounded, and the concentration was adjusted with a predetermined dilution solvent so as to obtain a predetermined solid content concentration, thereby preparing the composition for the surface layer. Next, the composition for the surface layer was roll-coated on the outer circumferential surface of the intermediate layer and a heat treatment was performed to form the surface layer on the outer circumference of the intermediate layer. Thereby, a development roll was produced.

The materials used as the surface layer material are as follows.

Styrene resin (1): "DIC Styrene CR-2500" (GPPS) produced by DIC

Styrene resin (2): "DIC Styrene XC-315" (GPPS) produced by DIC

Styrene resin (3): "DIC Styrene MH-6100-2" (HIPS) produced by DIC

Acrylic resin: "Parachron W-197C" produced by Negami Chemical Industrial Co., Ltd.

Polyvinylidene fluoride: "KF Polymer #850" produced by Kureha

Polyether sulfone: "Sumikaexcel 3600G" produced by Sumitomo Chemical Co., Ltd.

Aluminum oxide: "ORGATIX AL3001" produced by Matsumoto Fine Chemical Co., Ltd.

Tetraethyl orthosilicate: reagent

Polyamide imide: "VIROMAX HR-16NN" produced by TOYOBO Co., Ltd.

Nitrile rubber (NBR): "CTBN 1300×8" produced by PTI Japan

Polycarbonate: "Tarflon Neo AG1950" produced by Idemitsu Kosan Co., Ltd.

Isocyanurate: "Coronate HL" produced by Tosoh

Embodiment 6

The surface layer material was directly added to the composition for the intermediate layer, and the intermediate layer and the surface layer were formed simultaneously by a method of floating the surface layer material on the surface when forming the intermediate layer. Thereby, a development roll was produced. In this case, the entire surface of the intermediate layer was regarded as the surface layer even if it was not covered by the surface layer material.

Comparative Example 6

A development roll was produced in the same manner as Embodiment 15 except that the intermediate layer was not formed.

The volume resistivity, tensile fracture strain, and tensile elastic modulus of the surface layer material were measured using the composition prepared for the surface layer. Moreover, the volume resistivity and tensile elastic modulus of the intermediate layer material were measured using the composition adjusted for the intermediate layer. Then, image evaluation (solid followability evaluation, solid density measurement) and discharging property evaluation (measurement of residual charge) were performed for each of the produced development rolls. At the same time, durability evaluation was performed by a durability test. The compositions (parts by mass) of the surface layer material and the intermediate layer material and the evaluation results are shown in the following tables.

(Measurement of Volume Resistivity)

Each composition was bar-coated on release PET and a heat treatment was performed to form a film. The obtained film was peeled off from the release PET to obtain an evaluation sheet sample. The volume resistivity (Ω·cm) at the time when a voltage of 500V was applied to the evaluation sheet sample was measured in accordance with JIS-K6911 using an electric resistivity meter (measuring range: $10^4$ to $10^{18}$Ω) ("6517B electrometer" produced by Keithley Instruments).

(Measurement of Tensile Fracture Strain and Tensile Elastic Modulus)

Each composition was bar-coated on release PET and a heat treatment was performed to form a film. The obtained film was peeled off from the release PET to obtain an evaluation sheet sample. The evaluation sheet sample was punched into any shape, and the tensile fracture strain and tensile elastic modulus were measured in accordance with JIS K-7161, 7127 using the test piece.

(Image Evaluation)

The produced development roll was incorporated into a commercially available electrophotography multi-function printer ("DocuCentre-IV C2260", produced by Fuji Xerox Co., Ltd.) to output magenta solid images in an environment of 23.5° C.×52% RH using A4 size plain paper. Then, the density at 12 points equally between the initial printing part and the final printing part was measured using a white photometer (TC-6DS/A: produced by Tokyo Denshoku: lens: G lens, STANDARD value setting: 87.8), and the density difference between the maximum value and the minimum value was evaluated. The solid followability was considered to be good if the density difference was small. If the density difference was 0 or more and less than 0.5, the solid followability was "A", and if the density difference was 0.5 or more, the solid followability was "C".

(Discharging Properties)

A corotron (using a DC power supply) was disposed outside the central part in the roll axial direction with the distance between the roll surface and the core of the corotron set to 10 mm, and the roll surface was charged by applying a corona current of 100 μA (constant current) in a state of rotating the produced development roll in the circumferential direction at a rotation speed of 10 rpm in an environment of 23° C.×53% RH. Then, at a position rotated 90 degrees in the rotational direction from the charged position, the distance between the probe of the surface electrometer and the roll surface was set to 1 mm, and the surface potential on the roll surface was measured at one point in the central part in the roll axial direction. It was taken as the surface residual charge of the development roll. If the value of surface residual charge was 0V or more and less than 5V, the discharging properties were "A", if the value was 5V or more and less than 7.5V, the discharging properties were "B", and if the value was 7.5V or more, the discharging properties were "C".

(Durability)

The produced development roll was incorporated into a commercially available electrophotography multi-function printer ("DocuCentre-IV C2260", produced by Fuji Xerox Co., Ltd.), and a durability test was performed by outputting images in an environment of 23.5° C.×52% RH using A4 size plain paper. The development roll was taken out when a specified number of times was reached to visually check for breakage (crack, chipping) on the roll surface. If the durability limit of printing was 5000 sheets or more before breakage was confirmed, the durability was "A", if it was 1000 sheets or more and less than 5000 sheets, the durability was "B", and if it was 1000 sheets or less, the durability was "C".

TABLE 1

| | | Embodiment | | | | | | | |
|---|---|---|---|---|---|---|---|---|---|
| | | 1 | 2 | 3 | 4 | 5 | 6 | 7 | 8 |
| Surface layer | Styrene resin (1) | 100 | 100 | 100 | 100 | 100 | 100 | 100 | 100 |
| | Styrene resin (2) | — | — | — | — | — | — | — | — |
| | Styrene resin (3) | — | — | — | — | — | — | — | — |
| | Acrylic resin | — | — | — | — | — | — | — | — |
| | Polyvinylidene fluoride | — | — | — | — | — | — | — | — |
| | Polyether sulfone | — | — | — | — | — | — | — | — |
| | Aluminum oxide | — | — | — | — | — | — | — | — |
| | Tetraethyl orthosilicate | — | — | — | — | — | — | — | — |
| | Polyamide imide | — | — | — | — | — | — | — | — |
| | Nitrile rubber (NBR) | — | — | — | — | — | — | — | — |
| | Polycarbonate | — | — | — | — | — | — | — | — |
| | Isocyanurate | — | — | — | — | — | — | — | — |
| | Dilution solvent | MIBK | MIBK | MIBK | MIBK | MIBK | — | MIBK | MIBK |
| | Solid content concentration (mass %) | 0.5 | 2 | 5 | 20 | 2 | 10 | 2 | 2 |
| | Heating condition | 120° C. 60 min | 120° C. 60 min | 120° C. 60 min | 120° C. 60 min | 120° C. 60 min | — | 120° C. 60 min | 120° C. 60 min |
| | Film thickness (μm) | 0.1 | 1.0 | 3.0 | 4.0 | 1.0 | 0.8 | 1.0 | 1.0 |
| | Volume resistivity (Ω · cm) | $8.3 \times 10^{15}$ | $8.3 \times 10^{15}$ | $8.3 \times 10^{15}$ | $8.3 \times 10^{15}$ | $8.3 \times 10^{15}$ | $8.3 \times 10^{15}$ | $8.3 \times 10^{15}$ | $8.3 \times 10^{15}$ |
| | Tensile fracture strain (%) | 5.6 | 5.6 | 5.6 | 5.6 | 5.6 | 5.6 | 5.6 | 5.6 |
| | Tensile elastic modulus (MPa) | 3199 | 3199 | 3199 | 3199 | 3199 | 3199 | 3199 | 3199 |
| Intermediate layer | Thermoplastic polyurethane | 10 | 10 | 10 | 10 | 10 | 10 | — | — |
| | Acrylic resin (1) | — | — | — | — | — | — | 70 | — |
| | Acrylic resin (2) | — | — | — | — | — | — | — | 70 |
| | Carbon black | 3 | 3 | 3 | 3 | 0.1 | 3 | 5 | 5 |
| | Ether-based polyol | 60 | 60 | 60 | 60 | 60 | 60 | — | — |
| | Isocyanurate | 30 | 30 | 30 | 30 | 30 | 30 | 30 | 30 |
| | Solid content concentration (mass %) | 25 | 25 | 25 | 25 | 25 | 25 | 25 | 25 |
| | Film thickness (μm) | 20 | 20 | 20 | 20 | 20 | 20 | 20 | 20 |
| | Heating condition | 120° C. 60 min | 120° C. 60 min | 120° C. 60 min | 120° C. 60 min | 120° C. 60 min | 120° C. 60 min | 120° C. 60 min | 120° C. 60 min |
| | Volume resistivity (Ω · cm) | $9.2 \times 10^{9}$ | $9.2 \times 10^{9}$ | $9.2 \times 10^{9}$ | $9.2 \times 10^{9}$ | $7.3 \times 10^{12}$ | $9.2 \times 10^{9}$ | $3.7 \times 10^{10}$ | $6.5 \times 10^{10}$ |
| | Tensile elastic modulus (MPa) | 8 | 8 | 8 | 8 | 6.3 | 8 | 470 | 2934 |
| Product evaluation | Solid density | 0.809 | 0.825 | 0.855 | 0.843 | 0.859 | 0.824 | 0.813 | 0.792 |
| | Density difference | 0.241 | 0.228 | 0.211 | 0.207 | 0.244 | 0.226 | 0.265 | 0.274 |

TABLE 1-continued

| | Embodiment | | | | | | | |
|---|---|---|---|---|---|---|---|---|
| | 1 | 2 | 3 | 4 | 5 | 6 | 7 | 8 |
| Solid followability | A | A | A | A | A | A | A | A |
| Residual charge (V) | 2.67 | 3.67 | 3.99 | 7.32 | 4.94 | 2.54 | 3.99 | 4.87 |
| Discharging properties | A | A | A | B | A | A | A | A |
| Durability | A | A | A | A | A | A | A | B |

TABLE 2

| | | Embodiment | | | | | | | | |
|---|---|---|---|---|---|---|---|---|---|---|
| | | 9 | 10 | 11 | 12 | 13 | 14 | 15 | 16 | 17 |
| Surface layer | Styrene resin (1) | — | — | — | — | — | — | — | — | — |
| | Styrene resin (2) | 100 | — | — | — | — | — | — | — | — |
| | Styrene resin (3) | — | 100 | — | — | — | — | — | — | — |
| | Acrylic resin | — | — | 100 | 100 | — | — | — | — | — |
| | Polyvinylidene fluoride | — | — | — | — | 100 | — | — | — | — |
| | Polyether sulfone | — | — | — | — | — | 100 | — | — | — |
| | Aluminum oxide | — | — | — | — | — | — | 100 | — | — |
| | Tetraethyl orthosilicate | — | — | — | — | — | — | — | 100 | — |
| | Polyamide imide | — | — | — | — | — | — | — | — | 100 |
| | Nitrile rubber (NBR) | — | — | — | — | — | — | — | — | — |
| | Polycarbonate | — | — | — | — | — | — | — | — | — |
| | Isocyanurate | — | — | — | 30 | — | — | — | — | — |
| | Dilution solvent | MIBK | MIBK | MIBK | MIBK | DMF | DMF | toluene | methanol | NMP |
| | Solid content concentration (mass %) | 2 | 2 | 2 | 2 | 2 | 2 | 2 | 2 | 2 |
| | Heating condition | 120° C. 60 min | 120° C. 60 min | 120° C. 60 min | 120° C. 60 min | 120° C. 60 min | 120° C. 60 min | 120° C. 60 min | 120° C. 60 min | 220° C. 60 min |
| | Film thickness (μm) | 3.0 | 3.0 | 3.0 | 3.0 | 3.0 | 3.0 | 3.0 | 3.0 | 3.0 |
| | Volume resistivity (Ω · cm) | $2.2 \times 10^{19}$ | $1.5 \times 10^{15}$ | $5.8 \times 10^{14}$ | $1.7 \times 10^{14}$ | $1.1 \times 10^{15}$ | $1.3 \times 10^{15}$ | $3.0 \times 10^{16}$ | $3.0 \times 10^{15}$ | $4.3 \times 10^{16}$ |
| | Tensile fracture strain (%) | 5.1 | 40 | 263 | 130 | 60 | 40 | 0.12 | 0.1 | 46 |
| | Tensile elastic modulus (MPa) | 3604 | 2312 | 632 | 523 | 1105 | 2438 | 3144 | 4617 | 6512 |
| Intermediate layer | Thermoplastic polyurethane | 10 | 10 | 10 | 10 | 10 | 10 | 10 | 10 | 10 |
| | Acrylic resin (1) | — | — | — | — | — | — | — | — | — |
| | Acrylic resin (2) | — | — | — | — | — | — | — | — | — |
| | Carbon black | 3 | 3 | 3 | 3 | 3 | 3 | 3 | 3 | 3 |
| | Ether-based polyol | 60 | 60 | 60 | 60 | 60 | 60 | 60 | 60 | 60 |
| | Isocyanurate | 30 | 30 | 30 | 30 | 30 | 30 | 30 | 30 | 30 |
| | Solid content concentration (mass %) | 25 | 25 | 25 | 25 | 25 | 25 | 25 | 25 | 25 |
| | Film thickness (μm) | 20 | 20 | 20 | 20 | 20 | 20 | 20 | 20 | 20 |
| | Heating condition | 120° C. 60 min | 120° C. 60 min | 120° C. 60 min | 120° C. 60 min | 120° C. 60 min | 120° C. 60 min | 120° C. 60 min | 120° C. 60 min | 120° C. 60 min |
| | Volume resistivity (Ω · cm) | $9.2 \times 10^{9}$ | $9.2 \times 10^{9}$ | $9.2 \times 10^{9}$ | $9.2 \times 10^{9}$ | $9.2 \times 10^{9}$ | $9.2 \times 10^{9}$ | $9.2 \times 10^{9}$ | $9.2 \times 10^{9}$ | $9.2 \times 10^{9}$ |
| | Tensile elastic modulus (MPa) | 8 | 8 | 8 | 8 | 8 | 8 | 8 | 8 | 8 |

TABLE 2-continued

| | | Embodiment | | | | | | | | |
|---|---|---|---|---|---|---|---|---|---|---|
| | | 9 | 10 | 11 | 12 | 13 | 14 | 15 | 16 | 17 |
| Product evaluation | Solid density | 0.859 | 0.801 | 0.759 | 0.765 | 0.701 | 0.745 | 0.866 | 0.788 | 0.851 |
| | Density difference | 0.228 | 0.222 | 0.252 | 0.278 | 0.311 | 0.299 | 0.331 | 0.352 | 0.36 |
| | Solid followability | A | A | A | A | A | A | A | A | A |
| | Residual charge (V) | 5.6 | 3.41 | 4.06 | 3.77 | 2.11 | 3.29 | 2.2 | 2.75 | 4.76 |
| | Discharging properties | A | A | A | A | A | A | A | A | A |
| | Durability | A | A | A | A | A | A | B | B | A |

TABLE 3

| | | Comparative Example | | | | | |
|---|---|---|---|---|---|---|---|
| | | 1 | 2 | 3 | 4 | 5 | 6 |
| Surface layer | Styrene resin (1) | 100 | 100 | — | — | — | — |
| | Styrene resin (2) | — | — | — | — | — | — |
| | Styrene resin (3) | — | — | — | — | — | — |
| | Acrylic resin | — | — | — | — | — | — |
| | Polyvinylidene fluoride | — | — | — | — | — | — |
| | Polyether sulfone | — | — | — | — | — | — |
| | Aluminum oxide | — | — | — | — | 100 | 100 |
| | Tetraethyl orthosilicate | — | — | — | — | — | — |
| | Polyamide imide | 2 | 2 | 2 | 2 | 2 | 2 |
| | Nitrile rubber (NBR) | — | — | 100 | — | — | — |
| | Polycarbonate | — | — | — | 100 | — | — |
| | Isocyanurate | — | — | 30 | — | — | — |
| | Dilution solvent | MIBK | MIBK | toluene | NMP | toluene | toluene |
| | Solid content concentration (mass %) | 2 | 2 | 2 | 2 | 2 | 2 |
| | Heating condition | 120° C. 60 min | 120° C. 60 min | 120° C. 60 min | 120° C. 60 min | 120° C. 60 min | 120° C. 60 min |
| | Film thickness (μm) | 1.0 | 1.0 | 3.0 | 3.0 | 3.0 | 3.0 |
| | Volume resistivity (Ω · cm) | $8.3 \times 10^{15}$ | $8.3 \times 10^{15}$ | $1.8 \times 10^{10}$ | $7.2 \times 10^{12}$ | $3.0 \times 10^{16}$ | $3.0 \times 10^{16}$ |
| | Tensile fracture strain (%) | 5.6 | 5.6 | 714 | 67 | 0.12 | 0.12 |
| | Tensile elastic modulus (MPa) | 3199 | 3199 | 24 | 2011 | 3144 | 3144 |
| Intermediate layer | Thermoplastic polyurethane | 10 | — | 10 | 10 | — | N/A |
| | Acrylic resin (1) | — | — | — | — | — | |
| | Acrylic resin (2) | — | 70 | — | — | 70 | |
| | Carbon black | 10 | 2 | 3 | 3 | 1.5 | |
| | Ether-based polyol | 60 | — | 60 | 60 | — | |
| | Isocyanurate | 30 | 30 | 30 | 30 | 30 | |
| | Solid content concentration (mass %) | 25 | 25 | 25 | 25 | 25 | |
| | Film thickness (μm) | 20 | 20 | 20 | 20 | 20 | |
| | Heating condition | 120° C. 60 min | 120° C. 60 min | 120° C. 60 min | 120° C. 60 min | 120° C. 60 min | |
| | Volume resistivity (Ω · cm) | $8.3 \times 10^{6}$ | $8.7 \times 10^{13}$ | $9.2 \times 10^{9}$ | $9.2 \times 10^{9}$ | $3.7 \times 10^{13}$ | |
| | Tensile elastic modulus (MPa) | 20 | 3014 | 8 | 8 | 3014 | |

TABLE 3-continued

| | | Comparative Example | | | | | |
|---|---|---|---|---|---|---|---|
| | | 1 | 2 | 3 | 4 | 5 | 6 |
| Product evaluation | Solid density | 0.601 | 0.788 | 0668 | 0677 | 0.833 | 0.721 |
| | Density difference | 0.505 | 0.322 | 0.666 | 0.507 | 0.301 | 0.530 |
| | Solid followability | C | A | C | C | A | C |
| | Residual charge (V) | 1.93 | 8.3 | 2.9 | 3.5 | 9.51 | 2.44 |
| | Discharging properties | A | C | A | A | C | A |
| | Durability | A | A | C | C | C | C |

Comparative examples 1, 2, 5, and 6 do not have the intermediate layer of the resistance value specified in the present application with respect to the surface layer of high resistance specified in the present application. In comparative example 1, the resistance value of the intermediate layer is overly low. Comparative example 6 does not have the intermediate layer, and the surface layer of high resistance is provided in contact with the elastic substance layer of low resistance. Therefore, the charge accumulated in the surface layer is released easily, and image defects occurred due to decrease in solid followability. In comparative examples 2 and 5, the resistance value of the intermediate layer is overly high. Therefore, residual charge increases. In addition, comparative examples 3 and 4 do not have the surface layer of the resistance value specified in the present application. Since the resistance value of the surface layer is low, image defects occurred due to decrease in solid followability.

In contrast thereto, the embodiments have the intermediate layer of the resistance value specified in the present application with respect to the surface layer of high resistance specified in the present application. Thus, the charge accumulated in the surface layer is suppressed from releasing, and excellent solid followability is achieved. In addition, residual charge decreases, and excellent discharging properties are achieved as well. That is, according to the embodiments, it is possible to achieve maintenance of high charging properties as well as discharging properties to suppress image defects.

According to embodiments 1 to 4, if the thickness of the surface layer is in the range of 0.1 to 3.0 μm, better discharging properties are achieved. According to embodiments 2, 7, and 8, if the tensile elastic modulus of the intermediate layer is in the range of 5.0 to 500 MPa, better durability is achieved. According to embodiments 3 and 9 to 17, if the surface layer includes a resin, better durability is achieved. Furthermore, according to embodiments 3 and 9 to 17, if the tensile fracture strain of the surface layer is 5.0% or more, better durability is achieved.

Other Configurations

For other configurations, a development roll for an electrophotography device according to the disclosure includes a shaft member; an elastic substance layer formed on an outer circumference of the shaft member; an intermediate layer formed on an outer circumference of the elastic substance layer; and a surface layer formed on an outer circumference of the intermediate layer. A volume resistivity of the surface layer is in a range of $1.0\times10^{14}$ to $1.0\times10^{20}$ Ω·cm, and a volume resistivity of the intermediate layer is in a range of $1.0\times10^{7}$ to $1.0\times10^{13}$ Ω·cm.

The surface layer may include a resin. A tensile elastic modulus of the surface layer may be in a range of 500 to 7000 MPa. A tensile elastic modulus of the intermediate layer may be in a range of 5.0 to 500 MPa. A tensile fracture strain of the surface layer may be 5.0% or more. A thickness of the surface layer may be in a range of 0.1 to 3.0 μm. The surface layer may include one, two or more selected from a (meth)acrylic resin, a styrene resin, polyether sulfone, a fluorine resin, and polyamide imide. The intermediate layer may include polyurethane or a (meth)acrylic resin.

The development roll for the electrophotography device according to the disclosure includes the elastic substance layer, the intermediate layer, and the surface layer in this order on the outer circumference of the shaft member. The surface layer comprises a resin and the resin is one or two or more selected from a styrene resin, polyether sulfone, and polyamide imide. The volume resistivity of the surface layer is in the range of $1.0\times10^{15}$ to $1.0\times10^{20}$ Ω·cm and the volume resistivity of the intermediate layer is in the range of $1.0\times10^{9}$ to $1.0\times10^{13}$ Ω·cm. Therefore, it is possible to achieve maintenance of high charging properties as well as discharging properties to suppress image defects.

In this case, if the surface layer includes a resin, brittle fracture is suppressed due to improvement in stretch and the durability is improved. Then, if the tensile elastic modulus of the surface layer is in the range of 500 to 7000 MPa, the surface layer can be formed to be hard and have high resistance, and it is easy to maintain high charging properties. Also, if the tensile elastic modulus of the intermediate layer is in the range of 5.0 to 500 MPa, it is easy to make the intermediate layer softer than the surface layer. In addition, it is easy to set the volume resistivity of the intermediate layer to the desired range. Then, if the tensile fracture strain of the surface layer is 5.0% or more, brittle fracture is suppressed due to improvement in stretch and the durability is improved. Moreover, if the thickness of the surface layer is in the range of 0.1 to 3.0 μm, it is easy to achieve maintenance of high charging properties as well as discharging properties. Furthermore, if the surface layer includes one, two or more selected from a (meth)acrylic resin, a styrene resin, polyether sulfone, a fluorine resin, and polyamide imide, it is easy to form a hard and highly resistive surface layer. If the intermediate layer includes polyurethane or a (meth)acrylic resin, it is easy to achieve maintenance of high charging properties as well as discharging properties.

Although the embodiments and examples of the disclosure have been described above, the disclosure is not limited to any of the above embodiments and examples, and it is possible to make various changes without departing from the spirit of the disclosure.

What is claimed is:

1. A development roll for an electrophotography device, comprising:

a shaft member;

an elastic substance layer formed on an outer circumference of the shaft member;

an intermediate layer formed on an outer circumference of the elastic substance layer; and a surface layer formed on an outer circumference of the intermediate layer, wherein the surface layer comprises a resin and the resin is one or two or more selected from a styrene resin, polyether sulfone, and polyamide imide, a volume resistivity of the surface layer is in a range of $1.0\times10^{15}$ to $1.0\times10^{20}$ Ω·cm, and a volume resistivity of the intermediate layer is in a range of $1.0\times10^{9}$ to $1.0\times10^{13}$ Ω·cm.

2. The development roll for the electrophotography device according to claim 1, wherein the resin is the styrene resin.

3. The development roll for the electrophotography device according to claim 2, wherein a tensile elastic modulus of the surface layer is in a range of 500 to 7000 MPa.

4. The development roll for the electrophotography device according to claim 2, wherein a tensile elastic modulus of the intermediate layer is in a range of 5.0 to 500 MPa.

5. The development roll for the electrophotography device according to claim 2, wherein a tensile fracture strain of the surface layer is 5.0% or more.

6. The development roll for the electrophotography device according to claim 2, wherein a thickness of the surface layer is in a range of 0.1 to 3.0 μm.

7. The development roll for the electrophotography device according to claim 2, wherein the intermediate layer comprises polyurethane or a (meth)acrylic resin.

8. The development roll for the electrophotography device according to claim 1, wherein a tensile elastic modulus of the surface layer is in a range of 500 to 7000 MPa.

9. The development roll for the electrophotography device according to claim 8, wherein a tensile elastic modulus of the intermediate layer is in a range of 5.0 to 500 MPa.

10. The development roll for the electrophotography device according to claim 8, wherein a tensile fracture strain of the surface layer is 5.0% or more.

11. The development roll for the electrophotography device according to claim 8, wherein a thickness of the surface layer is in a range of 0.1 to 3.0 μm.

12. The development roll for the electrophotography device according to claim 8, wherein the intermediate layer comprises polyurethane or a (meth)acrylic resin.

13. The development roll for the electrophotography device according to claim 1, wherein a tensile elastic modulus of the intermediate layer is in a range of 5.0 to 500 MPa.

14. The development roll for the electrophotography device according to claim 1, wherein a tensile fracture strain of the surface layer is 5.0% or more.

15. The development roll for the electrophotography device according to claim 1, wherein a thickness of the surface layer is in a range of 0.1 to 3.0 μm.

16. The development roll for the electrophotography device according to claim 1, wherein the intermediate layer comprises polyurethane or a (meth)acrylic resin.

* * * * *